US006855015B2

(12) United States Patent
Scott et al.

(10) Patent No.: US 6,855,015 B2
(45) Date of Patent: Feb. 15, 2005

(54) DEVICE FOR ROTATING WITH A MULTISIDED SOCKET

(75) Inventors: Jon David Edward Scott, Vancouver (CA); Stephen Raymond Flood, New Westminster (CA)

(73) Assignee: Teleflex Canada Limited Partnership, Richmond (CA)

( * ) Notice: Subject to any disclaimer, the term of this patent is extended or adjusted under 35 U.S.C. 154(b) by 198 days.

(21) Appl. No.: 10/196,554

(22) Filed: Jul. 17, 2002

(65) Prior Publication Data

US 2004/0011271 A1 Jan. 22, 2004

(51) Int. Cl.[7] ..... B63H 5/12
(52) U.S. Cl. ..... 440/2; 324/207.22; 439/891
(58) Field of Search ..... 440/1, 2, 53, 57, 440/62; 324/207.2, 207.22; 439/825, 879, 891

(56) References Cited

U.S. PATENT DOCUMENTS 4,005,674 A * 2/1977 Davis ..... 440/1
4,405,195 A * 9/1983 Cherry et al. ..... 439/825
4,624,643 A * 11/1986 Ohlsson et al. ..... 440/2
5,094,637 A * 3/1992 Nakamura ..... 440/1
5,512,820 A * 4/1996 Alfors ..... 324/207.22
5,788,545 A * 8/1998 Borgersen et al. ..... 440/2
6,004,172 A * 12/1999 Kerek ..... 439/891
6,322,404 B1 * 11/2001 Magee et al. ..... 440/2

* cited by examiner

*Primary Examiner*—Lars A. Olson
(74) *Attorney, Agent, or Firm*—Norman M Cameron

(57) ABSTRACT

A device for rotating with a rotatable first member includes a second member having a portion engageable with the first member. The portion has a first part and a second part which is resiliently biased away from the first part. The second member tightly engages the first member. There may be a device for measuring rotation of the shaft such as a potentiometer. The rotation measuring device may include an electrical connector for the potentiometer including a socket and a post which is pressable into the socket. The device may also include a rotationally adjustable connector. There may be a coupling connected to the second member which includes a third member with a portion having n sides and a fourth member with a portion having n sides which receives the portion of the third member in a mating relationship, thereby allowing the device to be adjusted to a total of at least m.n rotational positions. The second member preferably has a projection which slidably engages a slot in the third member allowing for non-coaxial rotation, and minimal backlash, of the device for measuring rotation relative to the first member.

44 Claims, 8 Drawing Sheets

DEVICE FOR ROTATING WITH A MULTISIDED SOCKET

BACKGROUND OF THE INVENTION

This invention relates to a device for rotating with a rotatable member and, in particular, to a device which is capable of measuring trim angle for a marine craft.

There are many cases where screws, bolts, or other components having multisided sockets are rotated, sometimes accompanied by rotation of a member about an axis which is non-co-axial with the sockets. In addition it is sometimes necessary to measure very accurately the angle of rotation of such a component.

For example, such a component, often rotated by a hexagonal socket or a hexagonal drive nut, is used in marine drive systems. The angle of rotation of the component indicates the amount of trim.

It is an object of the invention to provide an improved device for rotating with a multi-sided member and which is capable of rotating with such a member without any significant backlash between the device and the member.

It is also an object of the invention to provide an improved device for rotating with a multi-sided member where the device can be rotated about an axis which is non-coaxial with the member, but without any significant backlash occurring between the device and the member during rotation thereof.

It is a further object of the invention to provide an improved connector for rotatably connecting to a member having a multisided portion and which can easily be adjusted to a plurality of different rotational positions greater in number than the number of sides of the multisided portion.

It is a further object of the invention to provide an improved device for measuring trim angle of a marine craft.

It is still further object of the invention to provide an improved electrical connector for such a device as well as for other applications.

SUMMARY OF THE INVENTION

According to one aspect of the invention there is provided a device for rotating with a first rotatable member. The device includes a second member having a portion engageable with the first member. The portion has a first part and a second part which is resiliently biased away from the first part. The second member thereby tightly engages the first member. For example the first member may have a multisided socket and the second member may include a multisided male member which fits non-rotatably with respect to the socket. In one embodiment the second member is split with a space between the first part and the second part.

According to another aspect of the invention there is provided a rotationally adjustable device for rotatably engaging a first member with a multisided portion. The device includes a second member having a multisided portion with m sides and is capable of receiving the first member in a mating relationship in m alternative rotational positions. There is a coupling connected to the second member which is generally coaxial with the second member. The coupling includes a third multisided member having n sides and an opening having n sides. The opening receives the third member in a mating relationship in n alternative rotational positions. The values m and n are different whole numbers and neither n nor m is a multiple of the other. The connector can be adjusted to a total of m.n rotational positions.

According to a further aspect of the invention, there is provided an electrical connector which includes a socket and a post which is tightly pressable into the socket. The post as a plurality of rows of circumferential projections extending thereabout. The projections tightly engage the socket when the post is pressed into the socket. For example the projections may comprise helical threads on the post.

According to a still further aspect of the invention, there is provided a rotation sensing apparatus for sensing a rotational position of a rotatable first member. The apparatus comprises a second member having a portion which is complementary in shape to the first member and is engageable with the first member for rotation therewith, the second member having a portion with m sides. A rotation measuring device measures a rotational position of the second member and thereby the rotational position of the first mechanism. A rotationally adjustable coupling operatively connects the second member to the rotation measuring device. The coupling includes a third member with a portion having n sides and a fourth member with a portion having n sides. The portion of the fourth member is complementary in shape to the portion of the third member and receives the portion of the third member in a mating relationship in n alternative rotational positions. The values m and n are different whole numbers and neither m nor n is a multiple of the other, whereby the apparatus can be adjusted to a total of at least m.n rotational positions.

The invention offers significant advantages compared to the prior art. It permits a device, such as a potentiometer, to be connected to a first rotatable member with zero backlash. This is highly desirable or necessary where the potentiometer is used to measure the degree of rotation of the first member. The invention accomplishes this by a second member having a portion engageable with the first member, the portion having a first part and a second part which is resiliently biased away from the first part. For example, the first member may have a multisided socket and the portion of the second member may be a male member which is split into two parts with a space therebetween. This provides a simple and reliable way of coupling a device to the first member with zero backlash without requiring machining of either component to high tolerances. This significantly reduces the associated production costs.

The invention also offers a simple but effective way of mounting a device, such as a potentiometer, at different rotational positions. This is done by providing a coupling with a third multisided member and a complementary shaped opening, where both the third member and the opening have different numbers of sides compared to the first member and the second member. The potentiometer or other such device can be rotated to a multitude of different rotational positions which equals the product of the number of sides on the portion of the second member and the number of sides of the third member and the opening. This arrangement is simpler and less expensive to construct than more elaborate adjustment mechanisms using, for example, slots and adjustment screws. Also the rotational position is not prone to slipping once set.

Electrical connectors according to the invention offer a quick and reliable way of connecting two conductors together. This is done by placing the conductors in a socket and then pressing a post with a plurality of rows of circumferential projections into the socket. This provides multiple point crimps between the post and the conductors which is highly desirable to ensure adequate electrical conductivity. At the same time, such connectors significantly reduce assembly time compared to some prior art connectors. The conductors are electrically connected simply by pressing the post into the socket. No soldering or threading of components is required.

DETAILED DESCRIPTIONS OF THE PREFERRED EMBODIMENTS

Figure 10:
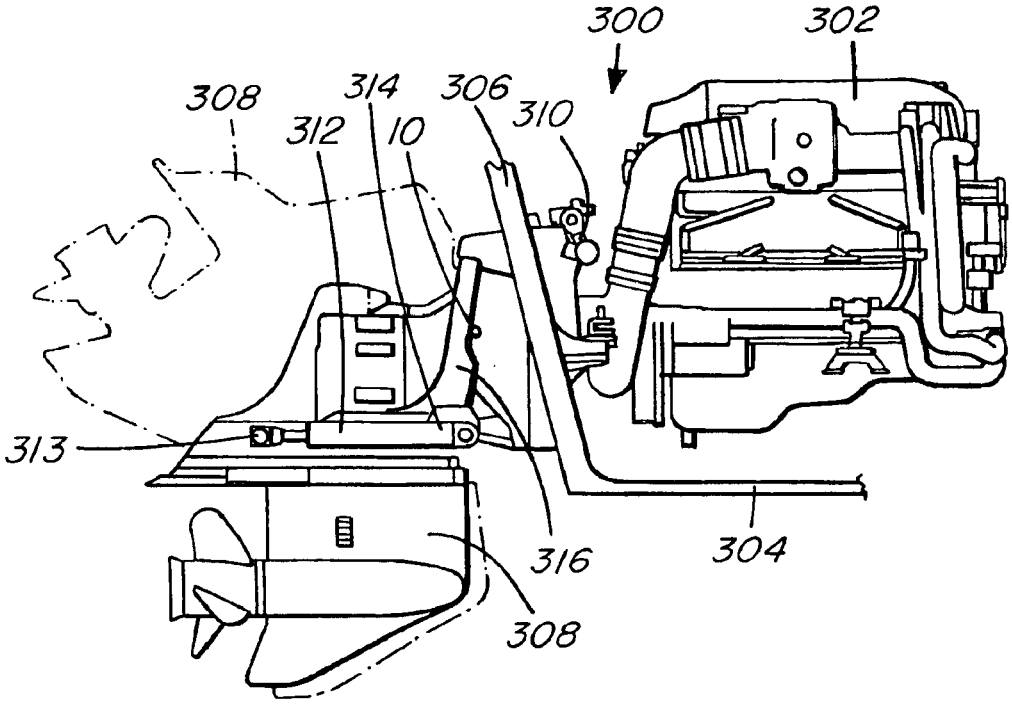
FIG. 10 is a side elevational view of an inboard/outboard motor according to an embodiment of the invention mounted on the transom of a boat, shown in fragment, with the stern drive shown in solid lines in the lowered position and in stippled lines in the raised position.
Figure 11:
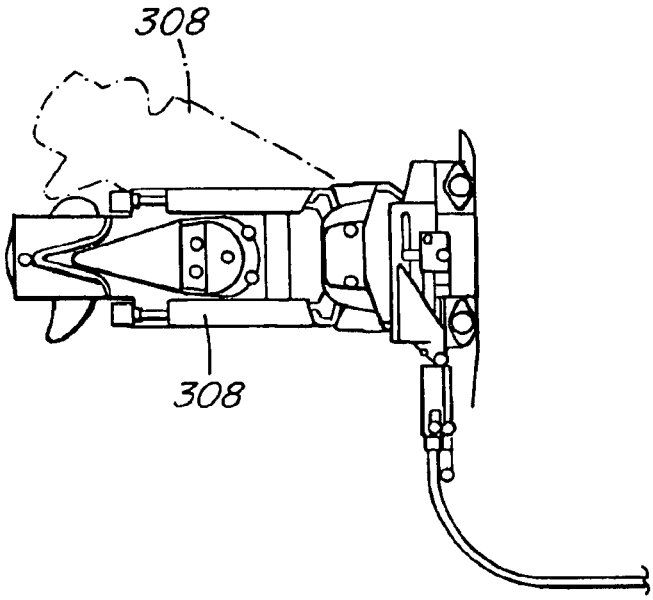
FIG. 11 is a top plan view of the stern drive thereof.

Referred to the drawings, and first FIGS. 10 and 11, these show a marine stern drive unit 300 which, in this example, includes an inboard/outboard motor 302 located within a boat 304 having a transom 306. A stern drive 308 is mounted on the transom and is pivotal between the lower position shown in solid lines and the raised position shown in stippled lines. There is a steering cylinder 310 used to steer the stern drive. The stern drive is raised and lowered by trim cylinders 312, only one of which is shown, there being a similar trim cylinder on the opposite side. The rear ends of the trim cylinders are mounted on the drive at 313 and the front ends 314 are mounted on a gimbal ring 316. The drive pivots up and down on two pins (not shown) which go through the gimbal ring. A trim sender 10 is mounted on the gimbal ring and has a nut, described below, which fits onto the pivot pin. The trim sender has a case, described below, which is mounted rigidly onto the gimbal ring, while the nut fits onto the pivot can which is mounted to the stern drive. Therefore the angle of tilt of the drive pin can be measured by the trim sender. The gimbal ring allows the stern drive to swing from side to side, as seen in FIG. 11, to allow steering without changing the trim.

Figure 1:
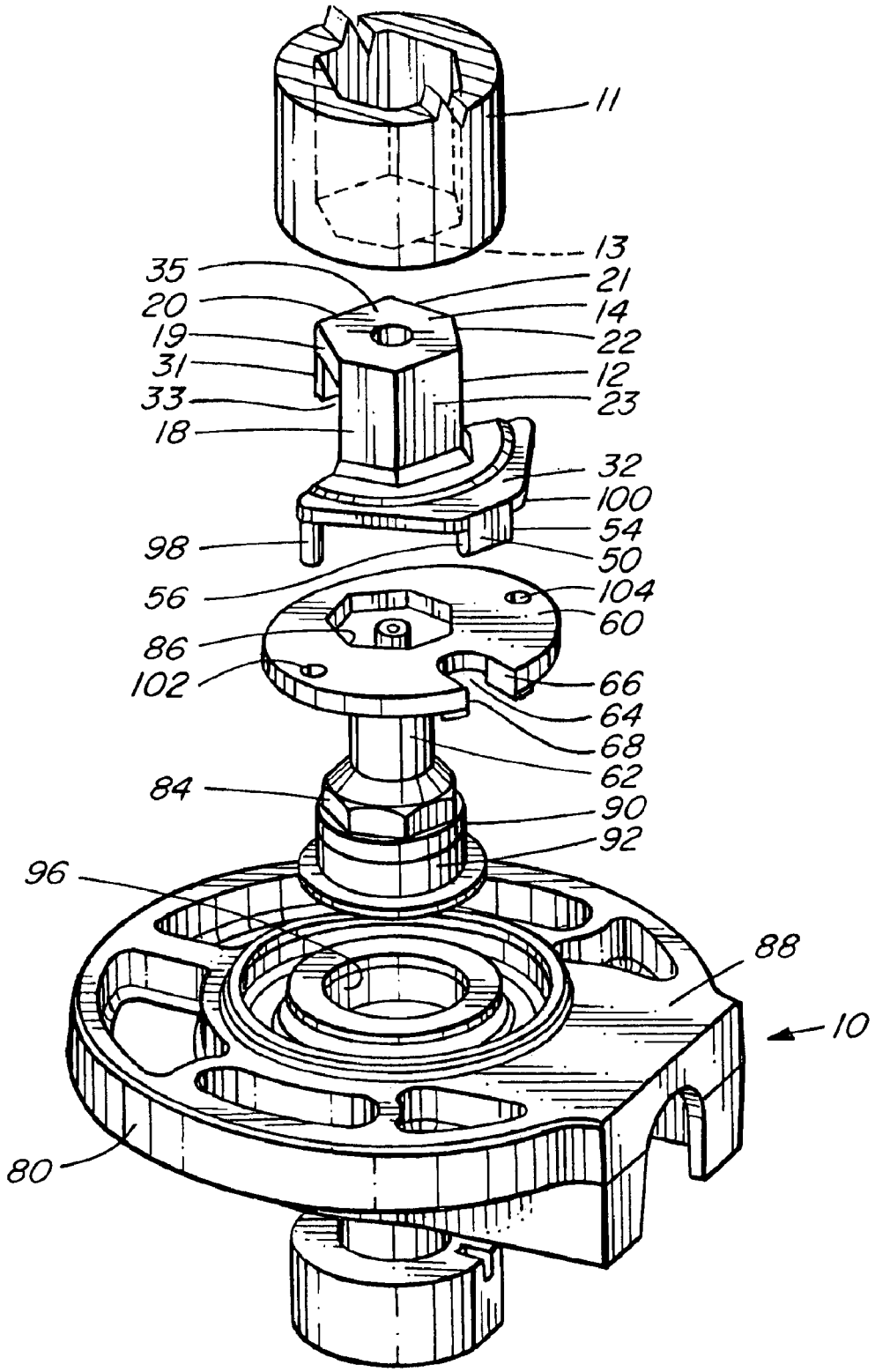
FIG. 1 is an exploded, isometric view of a device for rotating with a component, according to an embodiment of the invention.
Figure 2:
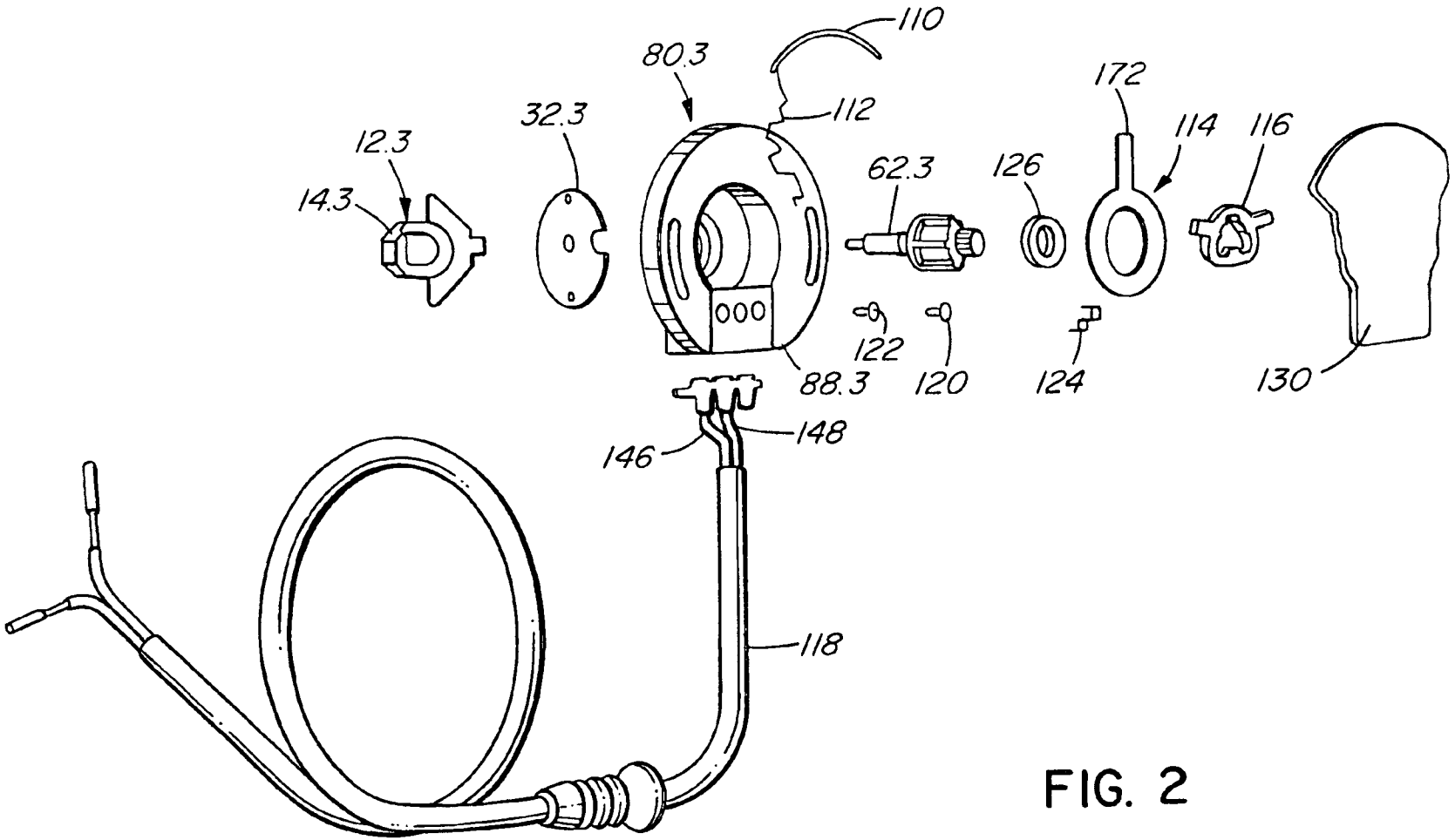
FIG. 2 is an exploded, isometric view of a device for rotating with a component, according to another embodiment of the invention.

Referring to FIG. 1, this shows the trim sender 10 which may be considered a device for rotating with a rotatable first member, in this example pivot pin 11, having a hexagonal socket 13. The degree of rotation of member 11 represents the trim of the stern drive. The device includes a second member 12, of plastic in this example, having a portion 14 which is insertable into the socket 13. Portion 14 of member 12 has six flat facets 18, 19, 20, 21, 22 and 23 which are profiled complementary to the socket. Alternatively the socket could be a conventional twelve sided socket or the member 12 and the socket could be shaped like a screw head and screwdriver or other members which engage non-rotatably with respect to each other.

A part of facet 20, the lower portion from the point of view of FIG. 1, is resiliently biased away from the rest of the socket. In this embodiment this is accomplished by a cantilevered, spring like part 31 which is separated from the rest of the member by gap 33 which extends upwardly to near outer end 35 of the member.

The member 12 includes a mount 32. As seen best in FIG. 1, the portion 14 is connected to the mount and extends outwardly therefrom. There is a projection 50 on the mount which, in this embodiment, is on the side thereof opposite portion 14 and extends in a direction opposite portion 14. The projection has two flat sides 54 and 56.

The device also includes a rotationally adjustable connector, or third member 60, mounted on a shaft 62. The connector 60 has a slot 64 with two parallel sides 66 and 68. The sides 66 and 68 are accurately made to tightly, but slidably receive the projection 50 of the mount such that the projection can slide along the slot without any play therebetween. It may be seen that the shaft 62 extends away from portion 14 of the member 12 when the projection 50 is received in the slot 64.

In use, the portion 14 of the member 12 is inserted into the socket 13. The cantilevered part 31 ensures that the facets 18, 19, 20, 21, 22 and 23 are held tightly against six sides of the socket with zero backlash.

Shaft 62 has a heptagonal portion, or fourth member 84, which is received within heptagonal opening 86 in connector 60 at a desired rotational position. The member 12 is therefore rotated simultaneously with shaft 62. The tight sliding relationship between projection 50 and slot 64 allows the member 11 to be rotated even when the shaft 62 is non-coaxial with the member 11, provided the offset is relatively slight.

A potentiometer 80 is mounted on shaft 62. The shaft 62 is rotatably mounted on potentiometer housing 88. There is a lip seal surface 90 and an elastomeric seal surface 92 on the shaft below the portion 84 which rotatably contacts a bore 96 in the housing. The potentiometer is generally similar to that of the next embodiment of the invention which is described in more detail below.

Mount 32 is trapezoidal shaped in this embodiment and has a pair of pins 98 and 100 which can be fitted within holes 102 and 104 on connector 60. When the pins are received in the holes, portion 14 of member 12 is coaxial with the shaft 62 and with the socket 13 rotated by the device. The holes allow member 12 to move off axis by a small amount, subject to projection 50 staying tightly between sides 66 and 68.

From a more general point of view, the member 11, or pivot pin of the marine drive, may be regarded as a rotatable member having a socket and device 10 may be regarded as a rotation sensing apparatus for sensing rotation of the rotatable member. The portion 14 of member 12 may be regarded as a mechanism engaging member which is complementary in shape to the rotatable member and is engageable with the rotatable member for rotation therewith. The portion 14 of member 12 has m sides, six in this example, for engaging a rotatable member having a socket with six or twelve sides.

The potentiometer 80 is a rotation measuring device for measuring a rotational position of the member 12 and accordingly the rotational position of the member 11 comprising, for example, the pivot pin of a marine drive. The connector 60, more particularly the heptagonal opening 86 therein, together with the shaft 62, more particularly heptagonal portion 84 thereof, operate as a rotationally adjustable coupling which operatively connects the member 12 to the rotation measuring device comprising potentiometer 80. The coupling includes a third member, namely connector 60, which is a multisided member in that it has a multisided opening 86 with n sides, seven in this example, and a fourth multisided member in the form of portion 84 of shaft 62 which is complementary in shape to the third member and receives the third member in a mating relationship in n different rotational positions. In other words, the shaft 62 can be turned, relative to socket 86, to seven different rotational positions with different sides thereof aligned with different sides of the socket.

It may be seen that portion 14 of member 12 has m sides and the coupling, comprising opening 86 and portion 84 of shaft 62, has n sides. In this particular example, these respective components have six and seven sides respectively, though in alternative embodiments the numbers of sides could vary, provided m and n are different whole numbers and neither n nor m is a multiple of the other. This allows the apparatus to be adjusted to a total of m.n different rotational positions when the portion 14 of member 12 is inserted into the pivot pin of a marine drive where the pivot pin has a socket with m sides. This is the case, for example, the pivot pin 11 has six sides. In other words, the portion 14 of member 12 can be rotated to six different rotational positions relative to the pivot pin and then portion 84 of the shaft can be rotated to seven different rotational positions relative to socket 86 for each of the rotational positions of member 12. This gives a total of 42 different rotational positions for mounting the shaft 62 of the potentiometer relative to the pivot pin. Alternatively, the number of different possible rotational positions is multiplied when the pivot pin has a socket with more sides, such as twelve sides. In that case the number of different possible rotational positions is increased to 84.

Figure 4:
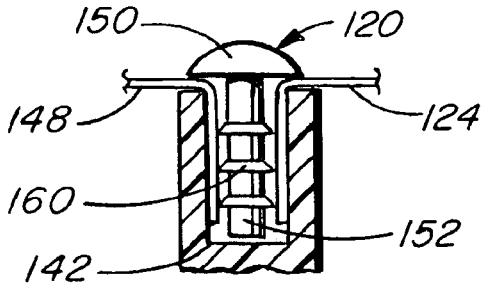
FIG. 4 is a sectional view of one of the electrical connectors thereof showing how external leads are connected thereto.
Figure 5:
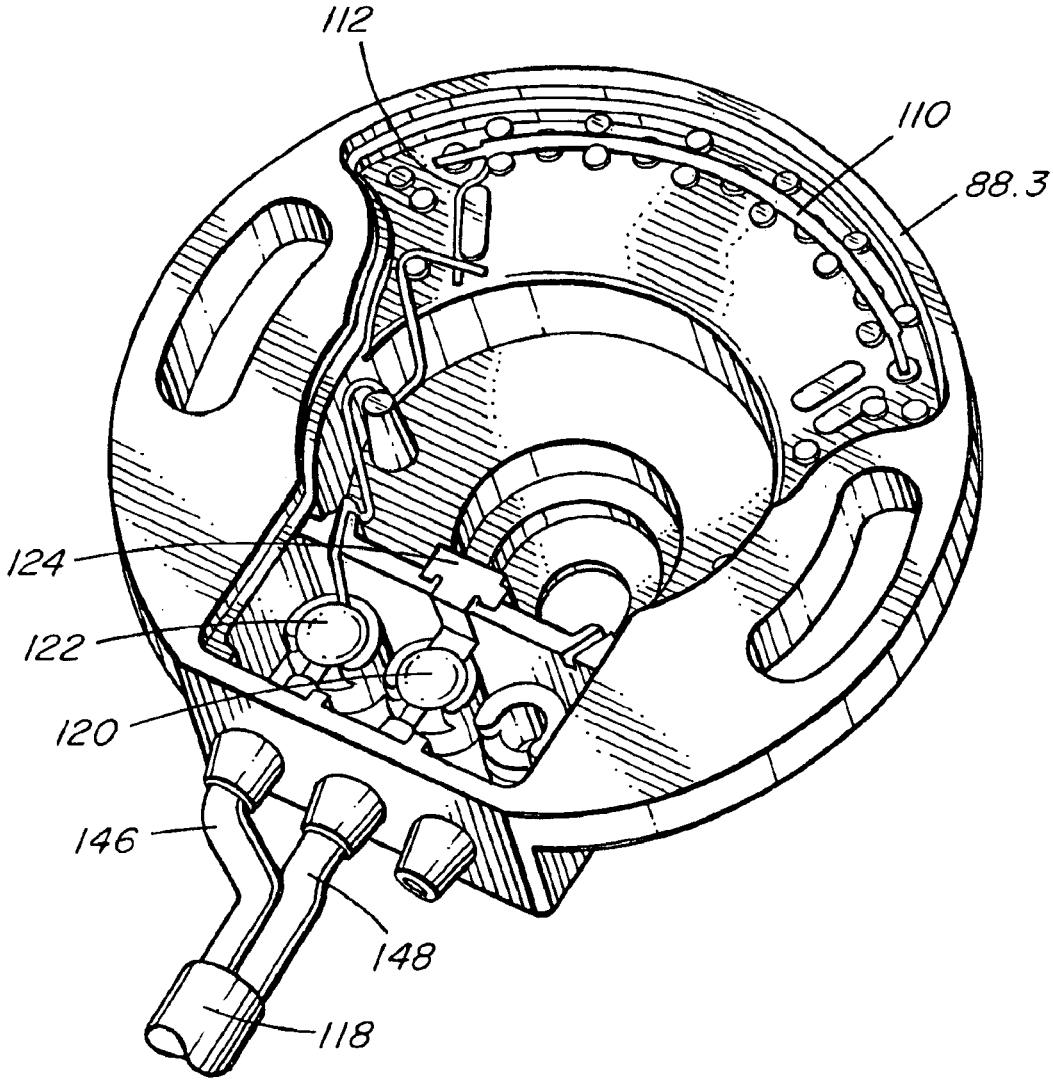
FIG. 5 is an isometric view similar to FIG. 3 showing external leads connected to the rheostat body by two connectors.
Figure 6:
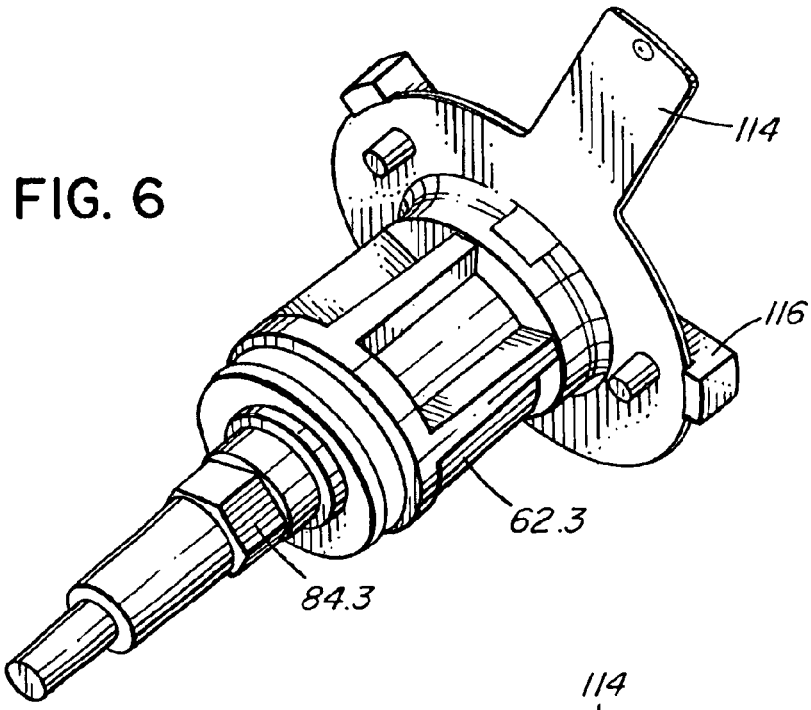
FIG. 6 is an isometric view of the shaft, wiper and wiper mount assembly thereof.
Figure 7:
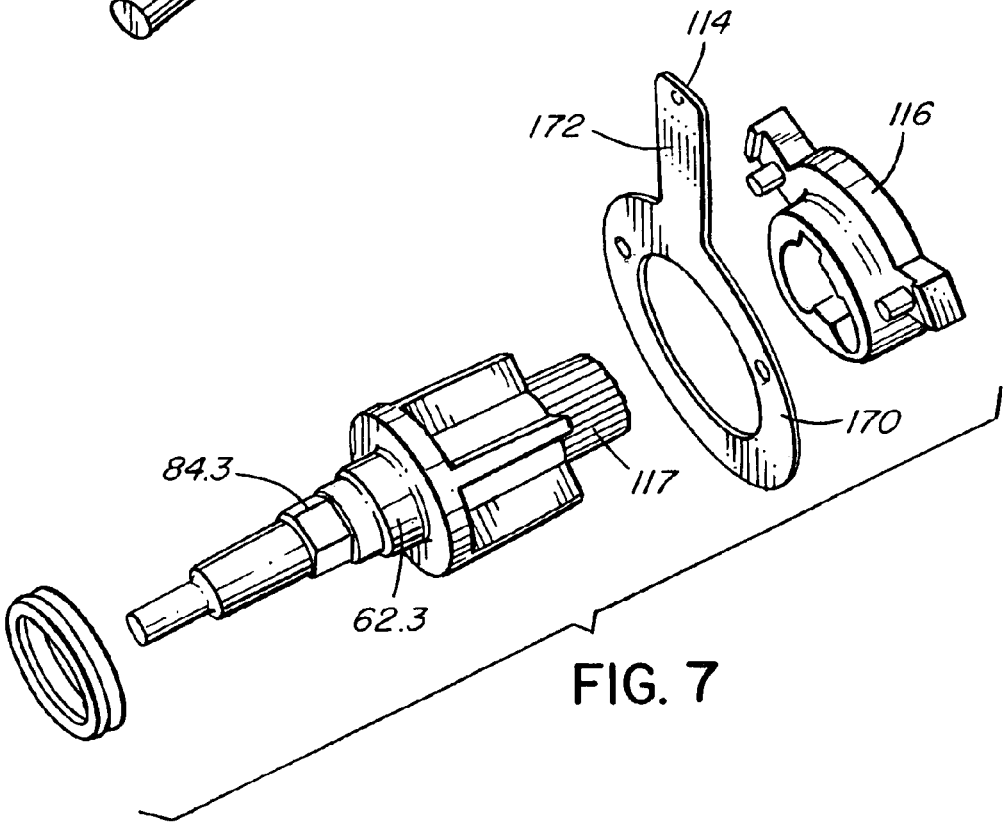
FIG. 7 is an exploded view of the assembly of FIG. 6.

FIGS. 2–8 illustrate another embodiment of the invention which is generally similar to the previous embodiments, like parts having like numbers with the additional designation ".3". Referring first to the exploded view of FIG. 2, potentiometer 80.3 as a body 88.3, shaft 62.3, a member 12.3 having a hexagonal portion 14.3 and a mount 32.3 generally similar to the embodiment above. The potentiometer has a resistor 110 having a lead 112 connected thereto. There is a wiper 114 mounted on the shaft 62.3 together with a wiper mount 116. These fit onto splined portion 117 of the shaft as best seen in FIGS. 6 and 7. There is a cable harness 118 connected to the potentiometer by drive screws 120 and 122 and contact 124. There is a quad ring 126 which fits about the shaft. A stationary lid 130 fits onto the body or housing 88.3.

Figure 3:
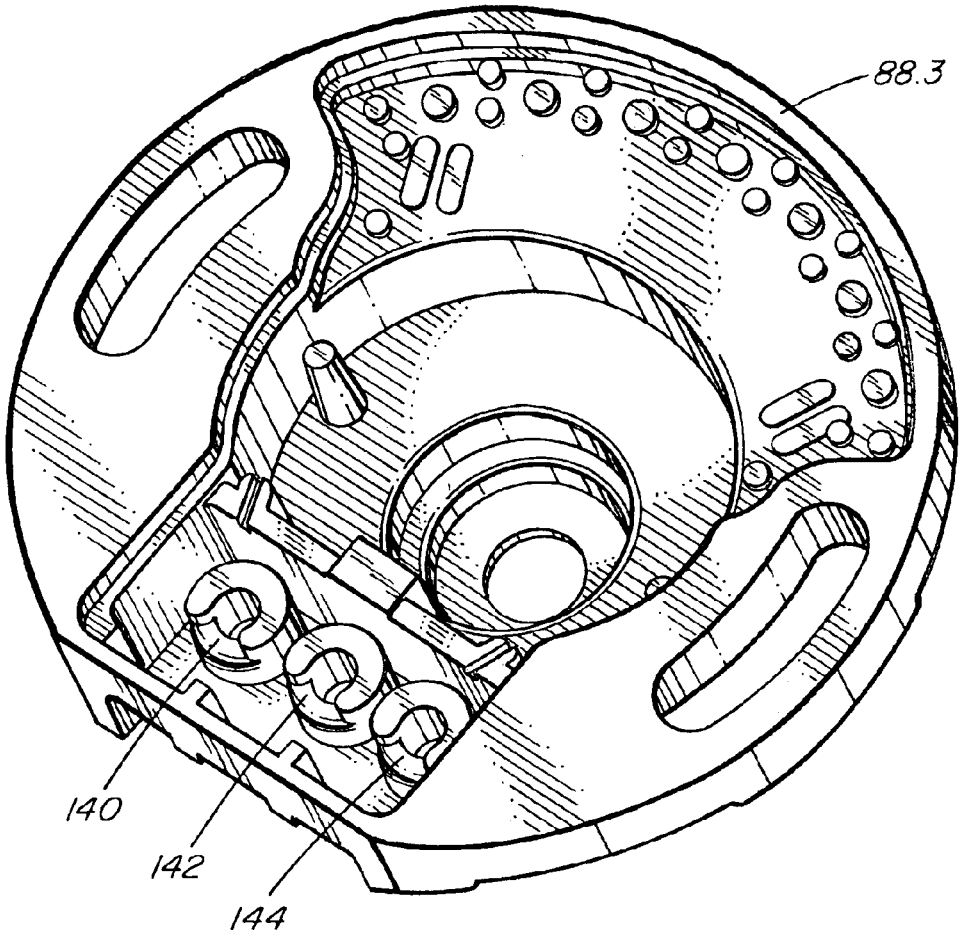
FIG. 3 is an isometric view of the rheostat body of the potentiometer thereof.

In this example body 88.3 of the potentiometer has three sockets 140, 142 and 144 formed therein as seen in FIG. 3. Wiring harness 118 of this embodiment has two conductors 146 and 148 which are connected to the potentiometer by the drive screws 122 and 120, as seen in FIG. 5. As seen in FIG. 4, each of the drive screws has a head 150 and a post 152 which is tightly pressable into one of the sockets, socket 142 in this example. Each of the posts has a plurality of rows of circumferential projections 160 which, in this example, are formed by helical threads on the post. Alternatively, the projections could be formed by parallel, spaced-apart annular projections. In either case, the projections tightly engage the socket when the post is pressed into the socket from above, from the point of view of FIG. 4. This is done using a tool 200 shown in FIGS. 8 and 9. A pair of electrical conductors, in this case conductor 148 and contact 124, are inserted into the socket between the post and the socket. Each of the conductors is crimped a plurality of times between the circumferential projections and the post. The other drive screw 122 is used to connect conductor 146 to lead 112. Annular portion 170 of wiper 114 contacts contact 124 while wiper arm 172 contacts resistor 110 of the potentiometer. The sockets in this example are formed in body 88.3 which is of an insulating material, namely plastic in this example. The posts are metal.

Figure 9A:
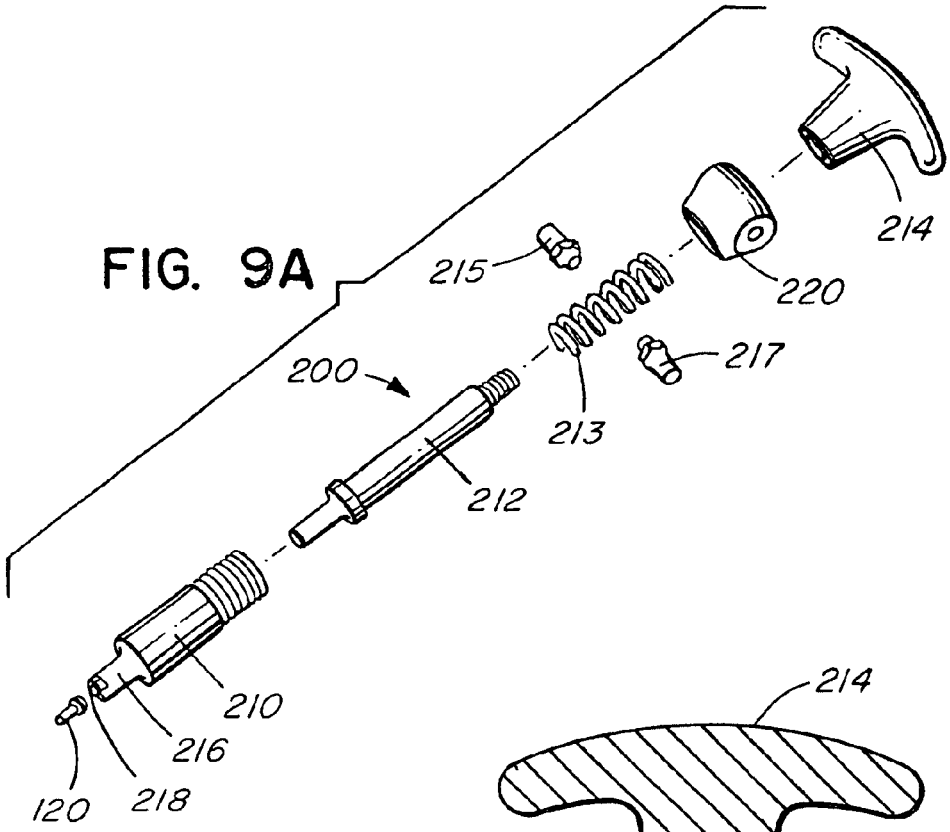
FIG. 9A is an exploded, isometric view thereof.
Figure 9:
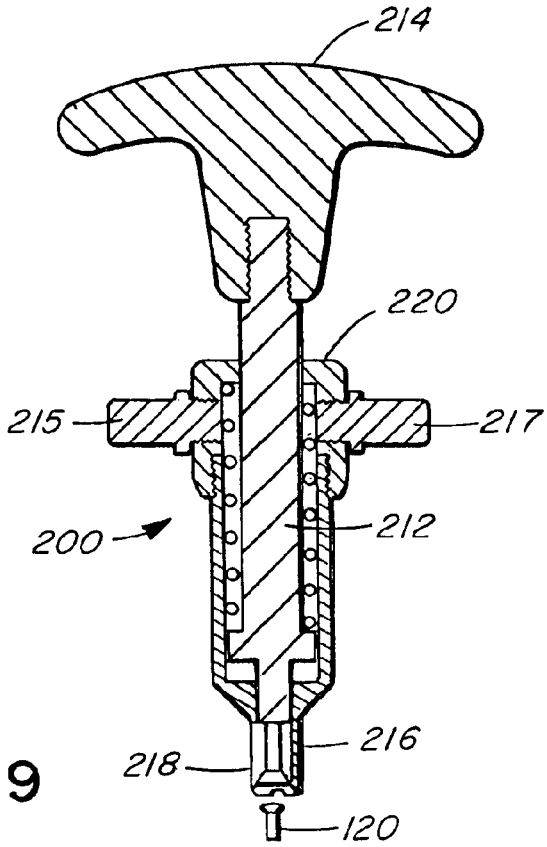
FIG. 9 is a sectional view of a pressing tool for pressing the post of the connector of FIG. 4 into the socket thereof.

Referring to FIGS. 9 and 9A, tool 200 is specially designed to hold the drive screws while they are being inserted into the sockets. The tool includes a sleeve 210 having a pin 212 therein. There is also a clamp spring 213, a push knob 214, a spring retaining cap 220 and two handles 215 and 217. Tip 216 of the sleeve is thin walled and internally slightly larger than the diameter of the drive screw 120. A small cut out 218 is in the side the sleeve tip to allow the fastener to slide into the tip of the tool from the side and be positioned on center. The tip of the sleeve is partially blanked off, only allowing the post of the fastener through. The pin fits inside the sleeve and is pushed down onto the head of fastener by the clamp spring. The clamp spring is retained by the spring retaining cap. The tip of the pin is shaped to match the top of the fastener. The push knob is mounted directly on the top of the pin. The spring is mounted on the sleeve to hold the spring in tension. The handles are mounted on the side of the sleeve to allow the opening of the tool with one hand.

In use, the pin is pulled back by pulling on the knob 214 while holding the sleeve. This can be done easily with one hand. While the pin is pulled back, the fastener is slid in from the side and the pin is allowed to return and hold the fastener securely in position. The fastener is then pushed into place. The tool can then be slid off the side of the installed fastener.

Figure 8:
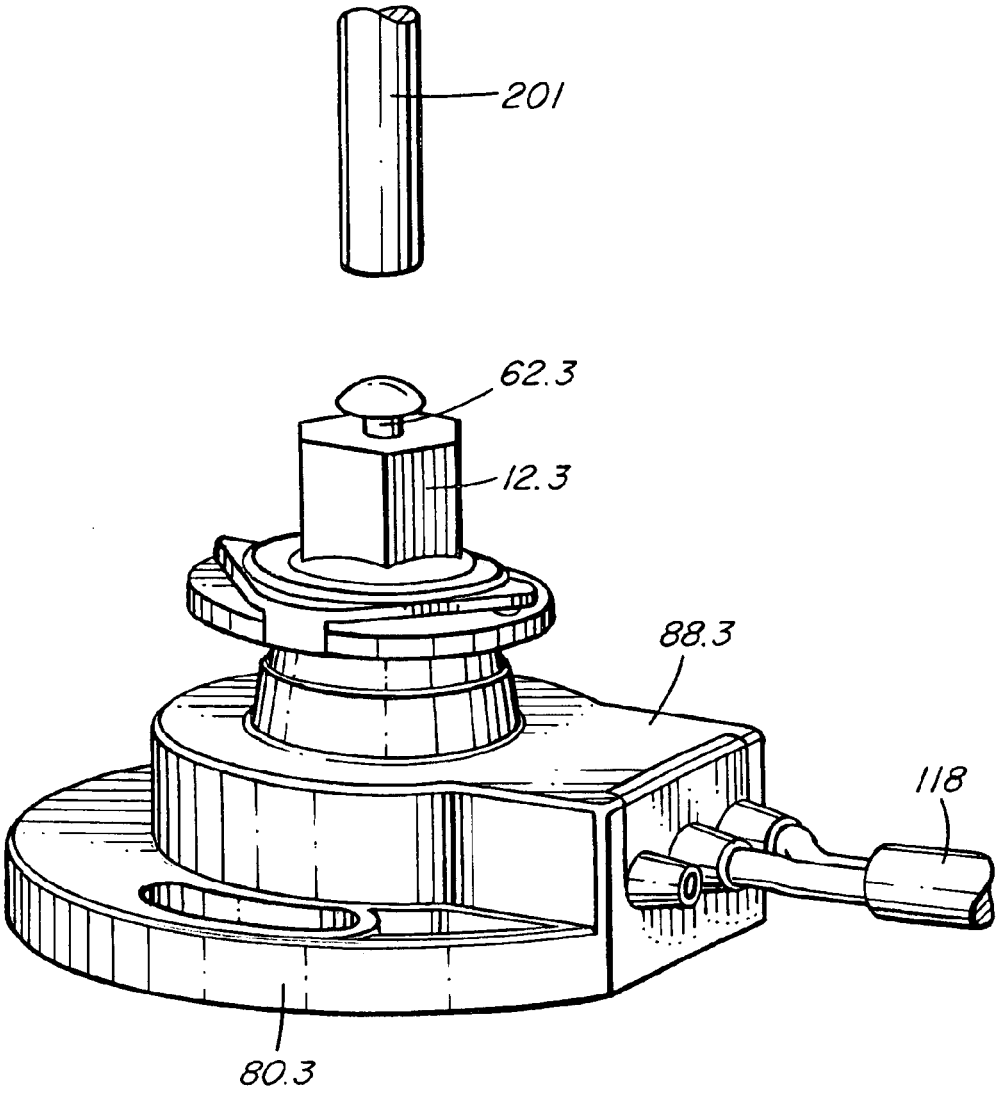
FIG. 8 is an assembled isometric view of the embodiment of FIG. 2, showing a heat staker being applied to the end of the shaft.

FIG. 8 shows the assembled apparatus including potentiometer 80.3. Tool 201 is used to heat stake shaft 62.3, which is plastic in this example, after the remainder of the unit is assembled.

It will be understood by someone skilled in the art that many of the details described above are by way of example only and are not intended to limit the scope of the invention which is to be interpreted with reference to the following claims.

What is claimed is:

1. A device for rotating with a first rotatable member, the device comprising a second member having a portion which is engageable with the first member, said portion having a first part and a second part, the first part being resiliently biased away from the second part, whereby the second member tightly engages the first member, the first member having a socket and the second member fitting non-rotatably within the socket.

2. The device as claimed in claim 1, wherein said second member is split with a space between the first part and the second part.

3. The device as claimed in claim 2, wherein the second part of the second member is resilient.

4. The device as claimed in claim 1, including a mount, the second member being connected to the mount and extending outwardly therefrom, the second member having an outer end which is distal to the mount, the second part extending from the outer end of the second member generally towards the mount.

5. The device as claimed in claim 4, wherein the second member has six facets which contact the first member within the socket.

6. The device as claimed in claim 4, including a rotationally adjustable connector, the mount engaging the connector.

7. The device as claimed in claim 6, wherein the connector has a slot, the mount having a projection closely and slidably received in the slot.

8. The device as claimed in claim 7, including a shaft engaging the connector.

9. The device as claimed in claim 8, wherein the shaft extends away from the portion of the device when the projection is received in the slot.

10. The device as claimed in claim 7, wherein the slot has parallel sides and the projection has flat parallel sides which are slidingly received between the sides of the slot.

11. The device as claimed in claim 9, including means for measuring rotation of the shaft.

12. The device as claimed in claim 11, wherein the means includes a potentiometer.

13. A rotationally adjustable device for rotatably connecting to a first member with a multisided portion, the device including a second multisided member having m sides, the second member being capable of engaging the first member in a mating relationship in at least m alternative rotational positions, and a coupling connected to the second member and being generally coaxial with the second member, the coupling including a third multisided member having n sides and a multisided opening having n sides, and receiving the third member in a mating relationship in n alternative rotational positions, m and n being different whole numbers and neither n nor m being a multiple of the other, whereby the connector can be adjusted to a total of at least m.n rotational positions.

14. The device as claimed in claim 13, wherein the members and the opening are polygonal.

15. The connector as claimed in claim 14, wherein each of the third member and the opening has sides equal in length.

16. The device as claimed in claim 13, the first member is a multisided socket and the second member and the third member are male multisided members.

17. An electrical connector including a socket and a post which is tightly pressable into the socket, the post having a plurality of rows of circumferential projections extending thereabout, whereby the projections tightly engage the socket when the post is pressed into the socket, a pair of electrical conductors being inserted between the post and the socket, whereby each of the conductors is crimped a plurality of times by the circumferential projections of the post.

18. The electrical connector as claimed in claim 17, wherein the socket is of an insulating material and the post is a conductor.

19. The electrical connector as claimed in claim 18, wherein the socket is of plastic and the post is of metal.

20. The electrical connector as claimed in claim 17, wherein the projections are helical threads on the post.

21. The electrical connector as claimed in claim 17, wherein the post has an enlarged head exterior to the socket.

22. A rotation sensing apparatus for sensing a rotational position of a rotatable first member, the apparatus comprising:

a second member having a portion which is complementary in shape to the first member and is engageable with the first member for rotation therewith, the second member having a portion with m sides;

a rotation measuring device for measuring a rotational position of the second member and thereby the rotational position of the first member; and a rotationally adjustable coupling which operatively connects the second member to the rotation measuring device, the coupling including a third member with a portion having n sides and a fourth member having a portion with n sides, the portion of the fourth member being complementary in shape to the portion of the third member and receiving the portion of the third member in a mating relationship in n alternative rotational positions, m and n being different whole numbers and neither n nor m being a multiple of the other, whereby the apparatus can be adjusted to a total of at least m.n rotational positions.

23. The apparatus as claimed in claim 22, wherein the portions of the third and fourth members are polygonal.

24. The apparatus as claimed in claim 23, wherein each of the portions of the third and fourth members has sides which are equal in length.

25. The apparatus as claimed in claim 22, the second member and the fourth member being male multisided members and the portion of the third member being a multisided opening.

26. The apparatus as claimed in claim 22, wherein m=n−1.

27. The apparatus as claimed in claim 22, wherein the first member has a socket and the portion of the second member is insertable into the socket, said portion of the second member having a first part with a plurality of sides which are profiled complementary to a portion of the socket and a second part which is resiliently biased away from the first part, the second member contacting the first member within the socket to tightly engage the first member.

28. The apparatus as claimed in claim 27, wherein the portion of the second member is shaped complementary to the socket of the first member.

29. The apparatus as claimed in claim 27, wherein said portion of the second member is split with a space between the first part and the second part thereof.

30. The apparatus as claimed in claim 29, wherein the second member includes a spring portion.

31. The apparatus as claimed in claim 22, wherein the rotation measuring device is a rotary potentiometer.

32. The apparatus as claimed in claim 31, wherein the potentiometer has a pair of electrical connectors for connecting electrical leads to the potentiometer, each said electrical connector including a socket and a post which is tightly pressable into the socket, the post having a plurality of rows of circumferential projections extending thereabout, whereby the projections tightly engage the socket when the post is pressed into the socket.

33. The apparatus as claimed in claim 32, including a pair of electrical conductors inserted between the post and the socket, whereby each of the conductors is crimped a plurality of times between the circumferential projections and the post.

34. The apparatus as claimed in claim 32, wherein the socket is of an insulating material and the post is a conductor.

35. The apparatus as claimed in claim 34, wherein the socket is of plastic and the post is a metal.

36. The apparatus as claimed in claim 32, wherein the projections are helical threads on the post.

37. The apparatus as claimed in claim 32, wherein the post has an enlarged head exterior to the socket.

38. The apparatus as claimed in claim 22, the second member including a mount, the portion of the second member being connected to the mount and extending outwardly therefrom, the second member having an outer end which is distal with respect to the mount, a spring portion extending from the outer end of the second member generally towards the mounting member.

39. The apparatus as claimed in claim 38, wherein the third member has a slot, the mount having a projection closely and slidably received in the slot.

40. The apparatus as claimed in claim 39, including a shaft extending from the rotation measuring device.

41. The apparatus as claimed in claim 40, wherein the shaft extends away from the second member when the projection is received in the slot.

42. The apparatus as claimed in claim 41, wherein the slot has parallel sides and the projection has flat parallel sides which are slidingly received between the sides of the slot.

43. The apparatus as claimed in claim 42, wherein the mount has pins which releasably engage corresponding apertures in the third member, the shaft and the first member being coaxial when the pins engage the apertures, the shaft and the first member being positioned for non-coaxial rotation of the shaft with respect to the first member while the projection is slidingly received in the slot.

44. In combination:

a boat having a transom;

a stern drive mounted on the transom, the stern drive being pivotable about a pivot pin; and a rotation sensing apparatus for sensing a rotational position of the pivot pin relative to the stern drive, the apparatus including a member having a portion which is complementary in shape to the pivot pin and is engageable with the pivot pin for rotation therewith, the member having a portion with m sides, a rotation measuring device for measuring a rotational position of the member and thereby the rotational position of the stern drive, and a rotationally adjustable coupling which operatively connects the member to the rotation measuring device, the coupling including a second member with a portion having n sides and a third member having a portion with n sides, the portion of the third member being complementary in shape to the portion of the second member and receiving the portion of the second member in a mating relationship in n alternative rotational positions, m and n being different whole numbers and neither n nor m being a multiple of the other, whereby the apparatus can be adjusted to a total of at least m.n rotational positions.

* * * * *